United States Patent [19]

Kadono

[11] Patent Number: 4,545,506

[45] Date of Patent: Oct. 8, 1985

[54] GAS PRESSURE OPERATED DISPENSING CONTAINER

[75] Inventor: Motoaki Kadono, Fukui, Japan

[73] Assignee: Toray Silicone Company, Ltd., Tokyo, Japan

[21] Appl. No.: 591,613

[22] Filed: Mar. 20, 1984

[30] Foreign Application Priority Data

Mar. 22, 1983 [JP] Japan ..... 58-41076[U]

[51] Int. Cl.[4] ..... B65D 35/28

[52] U.S. Cl. ..... 222/95; 222/386.5; 222/402.21; 222/402.23

[58] Field of Search ..... 222/95, 94, 386.5, 402.21, 222/402.22, 402.23; 53/319, 320

[56] References Cited

U.S. PATENT DOCUMENTS 3,662,926 5/1972 Umstead ..... 222/95

4,121,737 10/1978 Kain ..... 222/95

4,153,182 5/1979 Loeliger ..... 222/95

*Primary Examiner*—F. J. Bartuska

*Assistant Examiner*—David H. Bollinger

*Attorney, Agent, or Firm*—Howard W. Hermann

[57] ABSTRACT

There is disclosed herein a gas pressure operated dispensing container for viscous liquids in which a collapsible compartment containing the liquid is mounted inside a pressurized canister and has an end closure fitted with a dispensing valve having a elastomeric valve seal inside the compartment. A rigid reinforcing ring frictionally engages the end closure and prevents collapse of the top portion of the collapsible compartment. The ring has one or more air passages extending from a point on its internal periphery below the area of engagement with the end closure to the top thereof. The air passages are, for example, longitudinal notches in the ring spaced around its circumference and serve to allow air to pass out of the compartment as the end closure is applied.

4 Claims, 3 Drawing Figures

GAS PRESSURE OPERATED DISPENSING CONTAINER

BACKGROUND OF THE INVENTION

This application relates to gas pressure operated dispensing containers for automatically discharging viscous liquids such as sealants, caulking materials, adhesives, and pastes.

Viscous liquids for consumer use, such as room temperature moisture-curable liquid rubber, particularly room temperature moisture-curable silicone sealants, are commonly marketed in gas pressure operated dispensing containers. Such containers generally contain the viscous liquid in a collapsible compartment surrounded by a pressure chamber containing compressed gas inside a rigid canister. The outlet of the bag is fitted with a discharge valve via a collapse-preventing rigid ring. Upon manual activation of the valve the gas pressure forces collapse of the compartment and forces the viscous material from the bag through the valve to dispense the material.

In the filling and use of such dispensing containers it has been found that certain problems are encountered with present commercially used configurations. For example, it has been found that in the filling operation when the rigid ring and discharge valve are installed in the outlet of the collapsible compartment air may become entrapped in the compartment between the bottom of the discharge valve and the surface of the liquid to be dispensed. This may result in the formulation of air bubbles in the cured material. Obviously if the dispensed material is a sealant, porosity can result in an ineffective seal. Furthermore, if the material being dispensed is moisture-curable the entrapped air may contain sufficient moisture to cause curing in the container of at least a surface layer of the material, resulting at times in plugging of the valve, thereby rendering the container and its contents useless.

SUMMARY OF THE PRESENT INVENTION

It is an object of the present invention to provide a gas pressure operated dispensing container for viscous liquids which eliminates the aforementioned disadvantages in prior art constructions. Particularly it is an object of this invention to provide a gas pressure operated dispensing container construction which eliminates the possibility of air entrapment during filling and subsequent assembly.

In accordance with these and other objects, there is provided by the present invention a dispensing container having therein a pressure chamber for compressed propellant gas substantially surrounding a collapsible compartment filled with the viscous liquid which is to be discharged. As in prior art devices a discharge valve is installed via a rigid ring at the top of the container. There is provided by the invention, however, at least one continuous passage in the rigid ring from its inner circumference to its top; the opening of the passage at the inner circumference of the ring lying below the bottom of the support member for the discharge valve. With this construction, when the ring and discharge valve are installed in the collapsible compartment, any air entrapped between the bottom of the discharge valve and the surface of the liquid in the compartment is expelled through the passage during assembly of the device.

BRIEF DESCRIPTION OF DRAWINGS

Other objects and attendant advantages of the invention will become apparent from a reading of the following description of preferred embodiments when read in conjunction with the accompanying drawings wherein.

DESCRIPTION OF PREFERRED EMBODIMENTS

Figure 1:
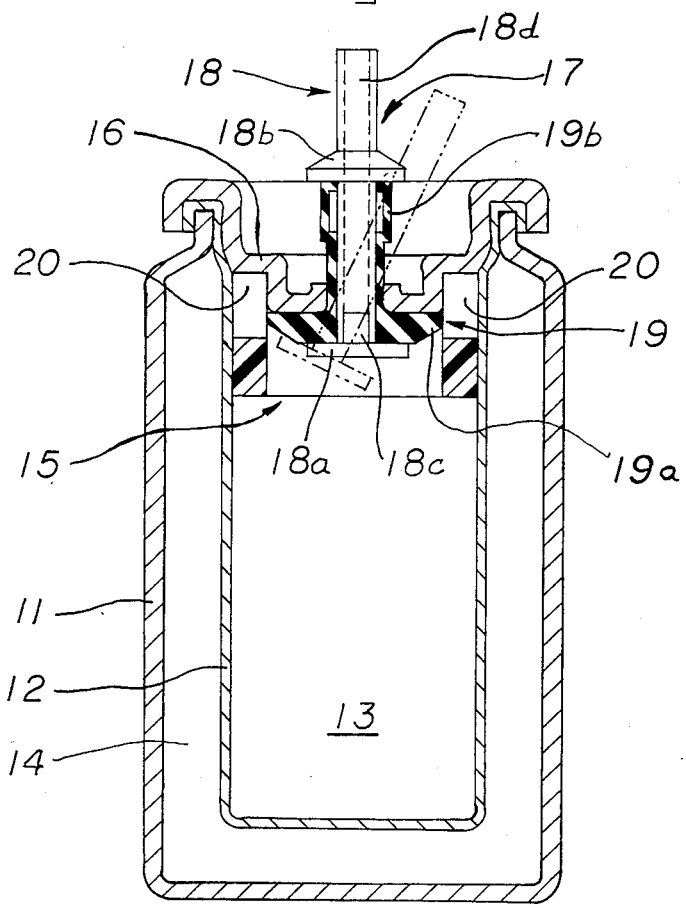
FIG. 1 is a vertical cross-sectional view of a cylindrical dispensing container made in accordance with the present invention.

Referring now to the drawings wherein like reference characters designate like or corresponding parts throughout the figures thereof, there is shown in FIG. 1 a cylindrical external canister 11 containing a cylindrical collapsible open topped container 12 which is preferably made of thin aluminum. The viscous liquid 13 to be dispensed from the container fills the volume defined by the container 12. The volume 14 defined by the space between the canister 11 and the collapsible container 12 acts as a pressure chamber and is filled with compressed inert gas such as Halon.

A rigid ring 15 which may be molded of any rigid plastic which is inert with respect to the viscous liquid 13 is installed in the outlet end of the collapsible container 12 to prevent the outlet portion of the container from being crushed by the compressed gas in the pressure chamber 14. A dispensing valve shown generally at 17 is installed inside the ring 15 and a cover plate 16 crimped to the ends of the canister 11 and flexible container 12 seals the unit and supports the valve 17.

The valve 17 is an assembly of a valve main body 18 made of relatively rigid material such as molded plastic and a rubber support 19 which supports the valve main body. The rubber support 19 forms a valve seal **19*a* below cover plate 16. The valve seal 19*a* is normally in sealing contact with valve flange 18*a* of valve main body 18. The peripheral surface of the rubber support contacts the inner circumference of the rigid ring 15. A projection 19*b* of rubber support 19 protrudes above the cover plate 16 and supports and elastically pushes upper flange 18*b* of the valve main body 18 upwardly in order to hold valve flange 18*a* in sealing contact with valve seal 19*a***.

When the discharge outlet **18*d* of 17 at the top of the valve main body is brought into contact with a workpiece and pushed gently, the valve main body 18, as seen by the broken line in the figure, is tipped, providing a space between the valve flange 18*a* and the valve seal 19*a*. As a result, the gas pressure inside the pressure chamber 14 partially collapses the compartment 12 causing the liquid materials 13 to flow into the valve through opening 18*c*, through the valve stem and out of discharge opening 18*d*. When the pushing force at the top of the main valve is released, the valve main body 18 is restored to its original position as shown in solid line by the elastic force of the rubber support 19, and the valve flange 18*a* agains seats itself against the valve seal 19*a***.

Figure 2:
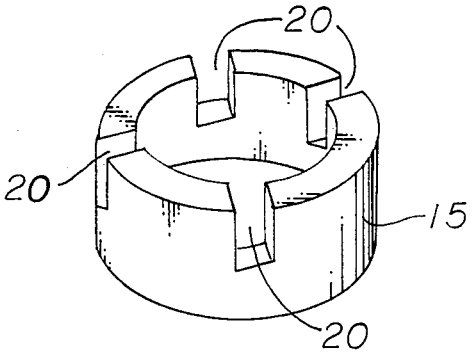
FIG. 2 is a view in perspective of the rigid valve assembly ring shown in the embodiment of FIG. 1.

As may be seen from FIG. 2, the rigid ring 15 has a plurality of notches 20 circumferentially spaced around its periphery and extending longitudinally from the top to any intermediate position on the peripheral wall. As may be seen from FIG. 1, the bottoms of the notches 20 are located below the location at which the outer periphery of valve seal 19*a* of rubber support 19 contacts the inner periphery of the ring 15 when the unit is assembled. Thus notches 20 are open to the contents of the collapsible compartment 13 below the bottom of the valve seal 19*a* when the ring is in place and form continuous passages at the top of the ring 15.

Figure 3:
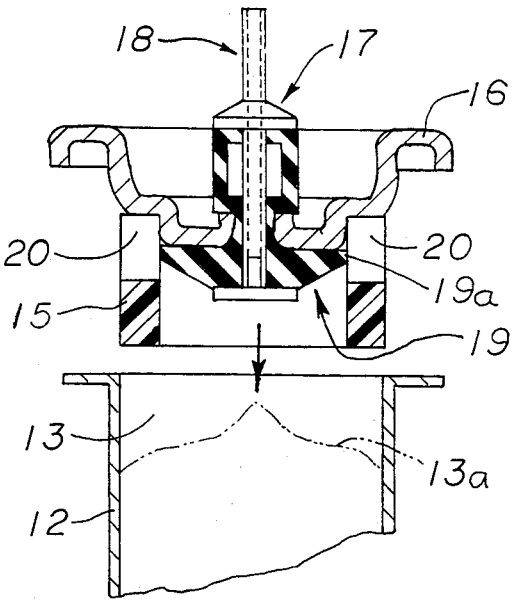
FIG. 3 is a cross-sectional view indicating the assembly of the valve and ring into the collapsible compartment to illustrate the functioning of the invention.

In the manufacture of filled containers, as shown by FIG. 3, the cover plate 16 is first fitted with the discharge valve 17 and the rigid ring 15 is fitted on the bottom of the cover plate and held in place by frictional engagement with the periphery of the valve seal 19*a* and a shoulder formed on the cover plate. The resulting integral structure is then installed into the open end of the collapsible compartment 12 which has been prefilled with the viscous liquid to be dispensed to the surface level shown by the broken line 13*a*. Although air is temporarily trapped between the bottom of the valve seal 19*a* encircled by the rigid ring 15 and the surface 13*a* of the liquid, it is expelled through the notches 20 as the cover and valve assembly descends into the compartment 12. When the container has been prefilled to the proper level some of the viscous liquid also passes into the notches 20. The filled compartment with cover and valve assembly can now be crimped to the top of the external canister 11 and the canister charged with compressed gas with no air entrapped in the top of the collapsible compartment. Thus, the possibility of air bubbles being entrained in the liquid being dispensed is eliminated and the possible moisture curing of the surface layer of liquid because of moisture in entrapped air is also eliminated. The rigid ring serves to prevent collapse of the collapsible compartment in the area surrounding the valve, preventing blocking of flow into the discharge valve.

While the above description is a preferred embodiment of the invention it is to be understood that modifications of the invention are contemplated. For example, although the collapsible compartment has been described as thin aluminum it is to be understood that plastic films or plastic film laminate of different polymers can be used. It is also to be understood that although the continuous air passage through the rigid ring has been described as a number of notches, a single notch can serve the purpose for air passage, although obviously it is conceivable in a single notch configuration that it is possible for an air bubble to be trapped at a point remote from the notch. Similarly the air passage or air passages may take the form of a groove or hole instead of a notch so long as a continuous passageway is formed as the ring is inserted into the flexible container to its maximum depth.

Obviously, other variations and modifications may occur to those skilled in the art from a reading of the foregoing. It is to be understood therefore that within the scope of the appended claims the invention may be practiced otherwise than as specifically described.

That which is claimed is:

1. In a gas pressure operated dispensing container for discharging viscous liquids wherein a collapsible compartment containing the liquid to be dispensed is mounted inside a pressurized canister and has an end closure fitted with a dispensing valve having an elastomeric valve seal inside the compartment, the improvement which comprises:

a rigid reinforcing ring including a peripheral wall having a top portion, said top portion of wall engaging a shoulder of a cover plate installed in an open end of the collapsible compartment, and said rigid reinforcing ring having an air passage extending through the peripheral wall from said top portion to a location below where the shoulder of the cover plate contacts the peripheral wall.

2. The improvement defined in claim 1 wherein said rigid reinforcing ring having a plurality of said air passages spaced from one another around the circumference thereof.

3. The improvement defined in claim 1 wherein said air passage is a longitudinal notch in the top portion of the ring.

4. The improvement as defined in claim 3 wherein a plurality of said air passages are formed by a plurality of longitudinal notches spaced from one another around a circumference of said ring.

* * * * *